United States Patent [19]

Okabe

[11] 4,068,344

[45] Jan. 17, 1978

[54] DOOR HINGE MECHANISM

[76] Inventor: Chiyo Okabe, 19-Go, 12-Banchi, Hirano, Osaka, Japan, 547

[21] Appl. No.: 734,459

[22] Filed: Oct. 21, 1976

[51] Int. Cl.[2] ..... E05F 3/20

[52] U.S. Cl. ..... 16/54; 16/56

[58] Field of Search ..... 16/54, 56, 58, 57, 66, 16/68, 82; 49/137

[56] References Cited

U.S. PATENT DOCUMENTS

| | | | |
|---|---|---|---|
| 1,226,258 | 5/1917 | Roger | 16/54 |
| 1,241,083 | 9/1917 | Bommer | 16/54 |
| 1,927,778 | 9/1933 | Hirakawa | 16/54 |
| 2,166,651 | 7/1939 | Wennmann | 16/54 |
| 2,456,537 | 12/1948 | Seaman | 16/54 |
| 2,485,937 | 10/1949 | Swanson | 16/54 |
| 2,490,258 | 12/1949 | Diebel | 16/54 |
| 2,493,116 | 1/1950 | Diebel | 66/54 X |
| 3,074,101 | 1/1963 | Hideyoshi | 16/54 |

*Primary Examiner*—Ronald Feldbaum
*Attorney, Agent, or Firm*—Bacon & Thomas

[57] ABSTRACT

A door hinge device applicable to a door, comprising a pair of flanges, a cylinder connected to one of these flanges and housed with a pair of pistons, a valve means formed on one of the pistons, a partition mounted between the flanges, an orifice formed on the partition, and a driving mechanism mounted externally of the cylinder, wherein the antiflow valve means is opened when the flanges move in the direction to open the door, but when they move in reverse direction to close the door, the valve means of the piston controllably permits a desired quantity of working oil to flow therethrough.

7 Claims, 6 Drawing Figures

DOOR HINGE MECHANISM

The present invention relates generally to improvements in a construction of a door hinge mechanism for freely opening and closing a door, being adapted especially to pivotally support said door, and more particularly to such a door hinge means that when the door is functionally ready to move in its closing direction, the means is able to automatically control the speed at which the door is moved in said direction on its closing stage thereby to prevent the door from being closed so rapidly.

Most of automatic door closing mechanisms available on the markets are generally in the form, for example, of a means that has a spring mounted on a pivotal support portion of a door so as to close the door by the dynamical stability of the spring or in the form of what is called "door check systems" particularly developed for the purpose.

Referring to the aforesaid door hinge means provided with a spring, the door is forcibly opened against the resiliency of the spring and made to return to its original position by the strong dynamical stability of the spring so that the speed ratio at which the door is being moved in its closing direction is rapidly increased; consequently more often than not it happens that a person passing by the door has inadvertently his hand or finger held by the door.

In addition, when the door is closed, it is forced to move in its closing direction so rapidly, causing a big noise inharmonious to the ear and violent impacts, that the main elements of said hinge means, lock means and the door elements are easily impaired.

Hitherto some of the above-mentioned drawbacks and disadvantages have been eliminated or at least mitigated for instance by developing door check systems. However, these are so expensive in the cost of manufacture, complicated in structure and needs a special room for mounting the system on a door frame portion.

Accordingly, the present invention has been designed to eradicate all the foregoing drawbacks and disadvantages by providing a door hinge mechanism wherein a pair of flanges are rigidly mounted on a door portion and a wall portion corresponding thereto, with one of said flanges including a cylinder and with the other including a flange supporting means pivotally supported on said cylinder, the inside of the cylinder being provided with a pair of pistons in a suitably spaced apart interval, wherein said pistons are filled with working oil and provided externally thereof with a movable mechanism for moving said pair of flanges in relatively opening and closing relation with one another.

Further between said pistons there is disposed a single partition which is formed with an orifice and a reversely stopping valve means adapted to be released when the flanges are moved in their opening direction only.

In the meanwhile, either of said pistons is provided with a valve means movable through said orifice of said partition thereby to control the quantity of working oil through the orifice in the latter half process of the flanges moving in the closing direction.

Namely, the present invention has for one of its main objects a provision of an improved door hinge mechanism capable of closing a door at a safety speed ratio by automatically controlling said speed before the door is closed.

Another object of the invention is to provide a door hinge mechanism adapted to change the opening and closing movements of a door into the axially linear movement so as to make the best of said cylinder and said pistons slidably moving in the axial direction thereby controlably feeding a desired quantity of working oit, with the result that the door is caused to open and close of itself at a safety speed.

Further object of the invention is to provide a door hinge mechanism wherein each elemental part constituting said speed control means has a considerable degree of strength to prove to be durable enough for a long use.

These and other objects, features and advantages of the present invention will become apparent from the following detailed description when taken in conjunction with the accompanying drawings, in which.

Figure 1:
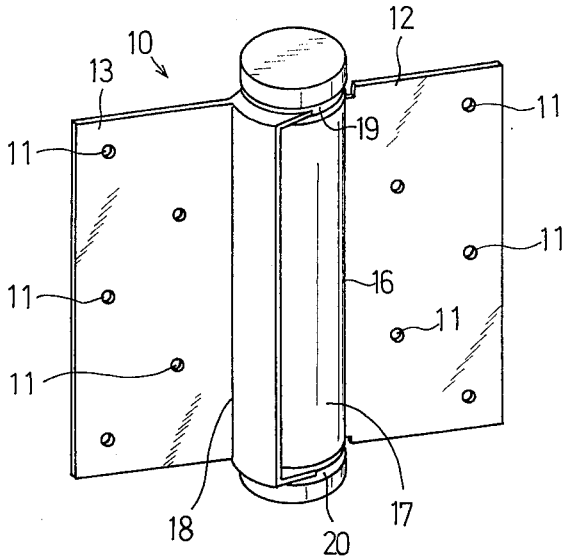
FIG. 1 is a perspective view showing the whole body of the door hinge mechanism embodied in accordance with the invention.

Referring now to the accompanying drawings, and first more particularly to FIG. 1, the reference numeral 10 generally designates a door hinge mechanism comprising a pair of flanges 12 and 13, said flange 12 being bored with a plurality of holes 11 while said flange 13 is adapted to move with respect to the former flange 12.

Figure 5:
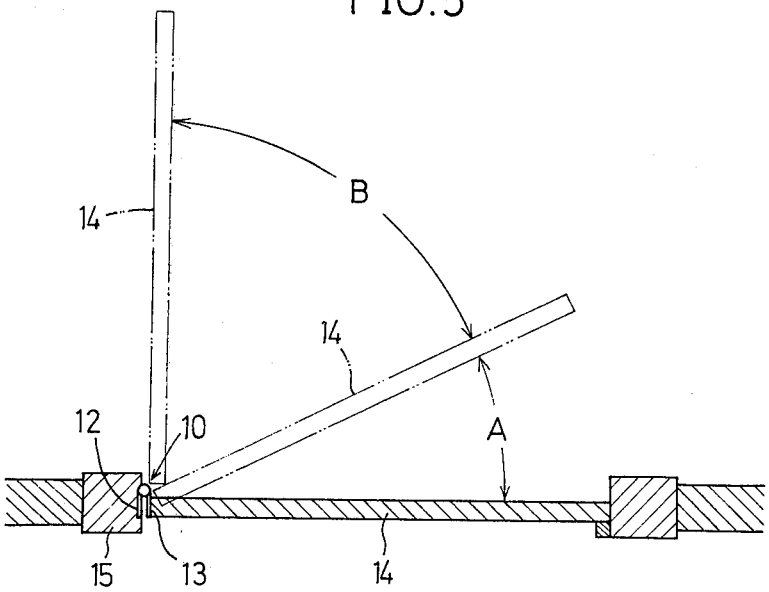
FIG. 5 is a top plan view showing the door hinge mechanism rigidly mounted on a door; and, FIG. 6 is a vertically sectioned elevational view showing in parts a modification of the door hinge mechanism embodied in accordance with the invention.

As is definitely shown in FIG. 5, said flange 12 is rigidly fixed to a supporting bar 15 pivotally supporting a door 14 by means of a suitable fixing means such as a screw or the like. Said movable flange 13 is rigidly fixed to the door 14 by means of a similar screw or the like.

Said fixture flange 12 is integrally connected along one edge 16 thereof to a cylinder 17 while said movable flange 13 is provided, on the upper and lower ends of an edge 18 disposed in opposition to the cylinder 17, with disc elements 19, 20 which are each formed in a manner to be disposed on said upper and lower ends of the cylinder 17.

On the upper disc element 19 there is fixedly mounted a freely rotatable upper axis 21 through said cylinder 17 by means of a screw 22. The outer surface of the axis 21 is sheltered with an upper cover 23.

Further the portion of said axis 21 inserted into the cylinder 17 is formed with a circular groove 25 in the position opposed to the upper edge portion 24 of the cylinder 17. In the circular groove 25 there is inserted a screw 26 screwably mounted to the cylinder 17 thereby preventing the upper disc element 21 from coming off the cylinder 17.

On the aforesaid lower disc element 20 there is rigidly mounted a lower cylindrical supporting axis 27 inserted into the lowermost end of said cylinder 17 by means of a screw 28. The outer surface of the axis 21 is also sheltered with a lower cover 29.

Said lower cylindrical supporting axis 27 is supported in the cylinder 17 in freely rotatable relation. In the inside of said cylinder 17 there are supported a pair of pistons 30, 31 at a suitably spaced apart interval. Between said pistons 30, 31 there is fixed working oil 32.

On the upper piston 30 there is mounted a key 33 inserted into a key groove 34 formed on the upper side portion of the cylinder 17 thereby to prevent the piston 30 from rotating.

Between the lowermost end surface area of said upper supporting axis 21 and the uppermost end surface area of said piston 30 there are formed sloping screw cams 35, 36 adapted to forcibly induce the piston 30 to come downward when the flanges 12, 13 are moved in relatively closing direction (or the direction where the door 14 is closed.)

Incidentally, the circular groove adjacent to the lowermost end of the piston 30 is formed with a groove 37 on which an oil seal means 38 is mounted.

Said lower piston 31 comprises a large diametral portion 39 and a small diametral portion 40, of which the former portion 39 is formed with a groove 41 hermetically sealed with an oil seal means 42, and the latter portion 40 is inserted into a hollow portion 43 of the lower supporting axis 27 so as to move in relatively slidable relationship.

Between the lower side portion 44 of the piston 31 and a notched portion 45 of the lower supporting axis 27 there is mounted a coil spring 46 for normally pressing the piston 31 upwardly.

In the center of said piston 31 there is disposed a valve means 47 which is provided in the lowermost end thereof with a screw 48 screwably engaged with a screw groove 49 engraved on the periphery of the piston 31. An oil seal means 50 is mounted between said piston 31 and said valve means 47.

In the intermediate portion of the pistons 30 and 31 is disposed a partition 51 fixed on the cylinder 17 by means of a screw 52. Said partition 51 is bored with an orifice 53 in the position corresponding to the valve means 47 and further formed with a reversely stopping valve means 54 which is adapted to permit the working oil 32 to pass therethrough when the lower piston 31 is pushed upwardly by means of the coil spring 46 (or when the door 14 is moved in its closing direction) but prevent the oil 32 from passing through the valve means 54 when the door 14 is moved in its opening direction.

Said valve means 47 is insertible into the orifice 53 bored on the portion 51 and remains inserted thereinto within the range that the lower piston 31 can move up and down. Further said valve means 47 is provided with upper and lower controlling portions 55, 56 formed by diametrally changing the valve means 47 so as to form each different cross-sectional surface area.

Said upper and lower controlling portions 55, 56 are adapted to control the quantity of working oil 32 being fed through the orifice 53 since said quantity will be reduced by the portion 55 but increased by the portion 56 while being fed through each portion 55, 56 and the orifice 53.

Said upper controlling portion 55 is workable within the range A including the whole process wherein the door 14 starts moving in its closing direction and arrives just at its closed position. In this range A the closing speed of the door 14 is controlled so that even if one happens to have his hand or finger held in the door 14 he will be free from a risk.

Said lower controlling portion 56 is workable within the range B including the whole process wherein the door 14 is completely opened and starts entering into the above-mentioned range A. In this range B the door 14 is controlled to move at a higher speed than in the range A.

The door hinge mechanism 10 arranged in the above-mentioned manner is such that, as is shown in FIG. 5 of the accompanying drawings, the fixture flange 12 is fixedly mounted on the supporting bar 15 by means of a suitable screw and the movable flange 13 is fixedly mounted on the door 14 by means of a similar suitable screw.

In the meanwhile, the door 14 (omitted in the accompanying drawings) is supported on the conventional type hinge means provided with returning springs so as to be normally pressed in the closing direction.

When the door 14 is in its closed state, the upper piston 30 is pressed downwardly by means of the sloping cams 35, 36 so that the lower piston 31 is also pressed downwardly by the pressure of the working oil 32.

Once the door 14 is released to open, the upper supporting axis 21 is moved to release the downward pressing force of the sloping cam 35 by the movement of the door 14 so that the lower piston 31 is pressed upwardly by the dynamical stability of the spring 46 to prevent the working oil 32 to be fed from the portion 51 and the upper piston 30 through the reversely stopping valve means 54 and the orifice 53 opened by the valve means 47.

Figure 2:
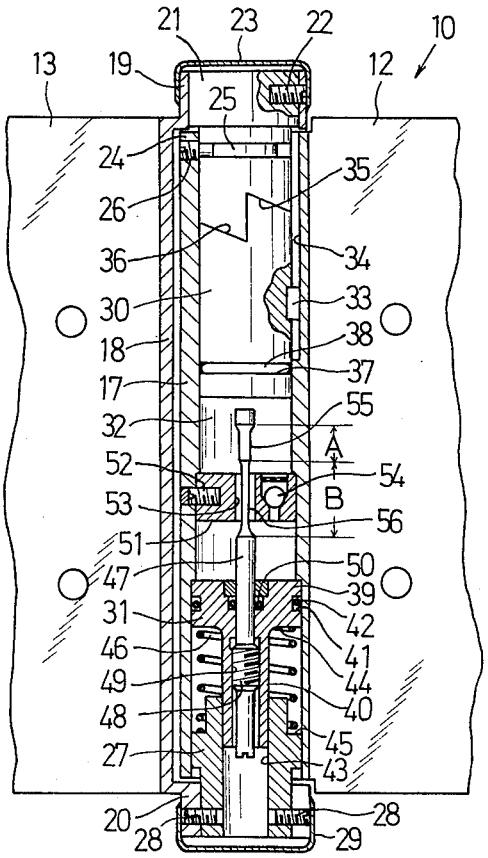
FIG. 2 is a vertically sectioned elevational view showing a state of said door hinge mechanism wherein the mechanism is shown as being kept opened.
Figure 3:
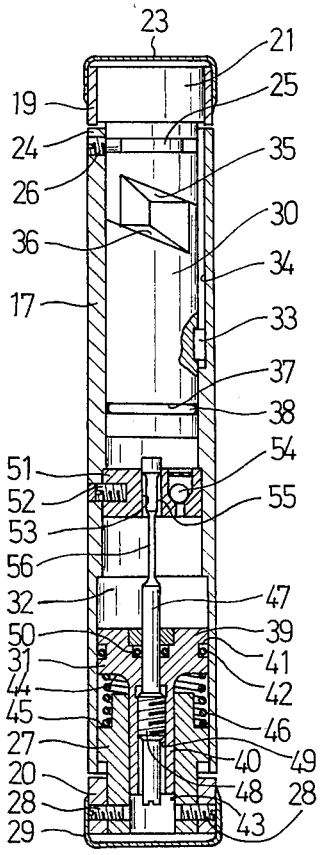
FIG. 3 is a vertically sectioned elevational view showing a state of the mechanism wherein the same is shown as being closed.
Figure 4:
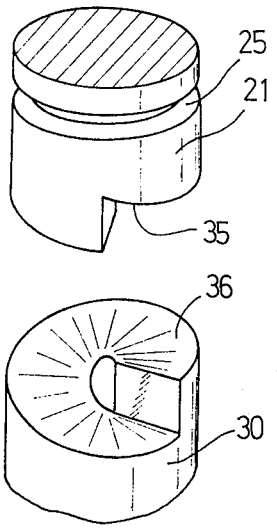
FIG. 4 is a partially cutaway perspective view of a movable means housed in the mechanism.

The above-mentioned state of the pistons 30, 31 is as definetely shown in FIG. 2 wherein the upper piston 30 is moved upwardly while the lowermost side of the lower controlling portion 56 of the valve means 47 is disposed to face the orifice 53 of the partition 51 by the upward movement of the lower piston 31.

In the next place, when the door 14 is released from its opening motion to move in its closing direction, the upper supporting axis 21 is also moved along with the movement of the door 14 thereby to press the sloping cam 36 of the upper piston 30 downwardly by means of the sloping cam 35 of said axis 21.

As has been mentioned above, when the upper piston 30 moved down, the working oil 32 of the upper side of the portion 56 is pressed and forcibly fed into the lower side of the piston 51 through the orifice 53. In this case, the reversely stopping valve means 54 is closed, and the working oil 32 is quantitatively controlled by the lower controlling portion 56 of the valve means 47. The control of the working oil 32 is further controlled by this portion 55 so that the moving speed of the door 14 into the closing direction is controlled to slow down at the initial stage of closing movement to the degree that no risk takes place even if one happens to have his hand or finger held by the door 14.

Figure 6:
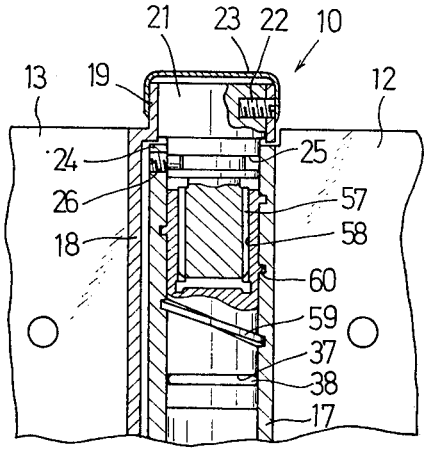

Incidentally, the mechanism for shifting the movement of the upper supporting axis 21 into the axial movement of the upper piston 30 shown in the foregoing embodiment may be replaceble with a following mechanism as shown in FIG. 6.

Namely, the upper supporting axis 21 has its lower half portion formed with a spline 57 and the upper piston 30 has its upper center formed with a groove 58 corresponding to the spline 57.

The upper piston 30 is formed in its outer periphery with a screw 59 and the cylinder portion 17 within the range of which said piston 30 can move up and down is also formed with a screw 60. The screws 59 and 60 are screwably engaged with one another.

Thus when the upper supporting bar 21 is moved along with the movement of the door 14, the moving force of said bar 21 causes the upper piston 30 to move up and down through means of said spline 57 and said groove 58.

Moreover, the mechanism adapted to move the lower piston 31 up and down as disclosed in the foregoing first embodiment of the present invention may be replaceable with the cam mechanism for moving the upper piston 30 up and down as shown in said first embodiment, or otherwise replaceable with a screw mechanism as shown in FIG. 6.

Furthermore, the controlling portions 55, 56 of the valve means 47 may be formed by shaving the periphery of the same means 47 axially thereof. Incidentally, this periphery may be shaved in its single or plural portions.

Though a few specific embodiments of the present invention has been shown and described herein, it will be apparent to those skilled in the art that the invention is not restricted to the details set forth but many changes and modifications may be made without departing from the spirit and scope of the invention as defined in the annexed claims.

What is claimed is:

1. A door hinge mechanism comprising a pair of flanges each fixedly mounted on a door and a means for fixedly mounting said mechanism on said door, one of said flanges being connected to a cylinder while the other is connected to a supporting means in pivotally supported relation with respect to said cylinder, a pair of pistons mounted internally of said cylinder at a suitably spaced apart interval, a working oil filled in said pair of pistons, a movable means mounted externally of said pistons to move the latter in upward and downward directions along with the relatively opening and closing motions of said flanges, a partition mounted between said pistons, an orifice and a reversely stopping valve means formed on said partition, said valve means being adapted to be released when said flanges are moved in the opening direction thereof, a valve means formed on one of said pistons reciprocable through said orifice of the partition thereby to control the quantity of working oil to be fed through said orifice during the latter half process wherein said pair of pistons have moved in the closing direction of said flanges.

2. The door hinge mechanism, as set forth in claim 1, wherein said movable means for moving said pistons upwardly and downwardly are each adapted to move one of said pistons by means of cam mechanism while the other is moved by means of a spring.

3. The door hinge mechanism, as set forth in claim 1, wherein said movable means for moving said pair of pistons upwardly and donwwardly are each composed of cam mechanisms.

4. The door hinge mechanism, as set forth in claim 1, wherein said movable means for moving said pistons upwardly and downwardly are each adapted to move one of said pistons by means of a screwably engageable structures while the other is moved by means of a spring.

5. The door hinge mechanism, as set forth in claim 1, wherein said movable means for moving said pistons upwardly and downwardly are each composed of said screwably engageable structures.

6. The door hinge mechanism, as set forth in claim 1, wherein said movable means for moving said pistons upwardly and downwardly are each adapted to move one of said pistons by means of said screwably engageable structures while the other is moved by means of a cam mechanism.

7. The door hinge mechanism, as set forth in claim 1, wherein the quantity of working oil to be fed into said orifice of said partition through said valve means is controlled by changing the cross-sectional surface are of said valve means.

* * * * *